US011335282B2

(12) United States Patent
Lee

(10) Patent No.: US 11,335,282 B2
(45) Date of Patent: May 17, 2022

(54) DRIVING METHOD FOR DISPLAY PANEL AND DRIVING DEVICE THEREOF

(71) Applicant: HKC Corporation Limited, Shenzhen (CN)

(72) Inventor: Chia-Hang Lee, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 466 days.

(21) Appl. No.: 16/461,367

(22) PCT Filed: Nov. 13, 2018

(86) PCT No.: PCT/CN2018/115211
§ 371 (c)(1),
(2) Date: May 15, 2019

(87) PCT Pub. No.: WO2020/087570
PCT Pub. Date: May 7, 2020

(65) Prior Publication Data

US 2021/0335293 A1 Oct. 28, 2021

(30) Foreign Application Priority Data

Oct. 30, 2018 (CN) ..... 201811273767.6

(51) Int. Cl.
*G09G 3/36* (2006.01)

(52) U.S. Cl.
CPC ..... *G09G 3/3607* (2013.01); *G09G 3/3648* (2013.01); *G09G 2300/0443* (2013.01); *G09G 2320/028* (2013.01); *G09G 2320/0276* (2013.01); *G09G 2340/06* (2013.01)

(58) Field of Classification Search
CPC ..... G09G 2300/0443; G09G 2320/028; G09G 2320/0276; G09G 2340/06; G09G 3/3607; G09G 3/3648
See application file for complete search history.

(56) References Cited

U.S. PATENT DOCUMENTS

2009/0189925 A1* 7/2009 Huang ..... G09G 3/3611 345/691
2010/0259556 A1* 10/2010 Inuzuka ..... H04N 11/06 345/604
2017/0140715 A1* 5/2017 Lien ..... G09G 3/2003

FOREIGN PATENT DOCUMENTS

CN 101228727 A 7/2008
CN 102063879 A 5/2011
CN 102483904 A 5/2012
CN 102957934 A 3/2013
(Continued)

OTHER PUBLICATIONS

International Search Report issued in corresponding International application No. PCT/CN2018/115211, dated Jul. 29, 2019 (6 pages).
(Continued)

*Primary Examiner* — David Tung

(57) ABSTRACT

Provided are a driving method for a display panel and a driving device thereof. The driving method includes: dividing pixels into bright pixels and dark pixels that are in a cross arrangement; converting driving signals into bright region driving signals and dark region driving signals; and driving the bright pixels and the dark pixels respectively by using the bright region driving signals and the dark region driving signals.

13 Claims, 5 Drawing Sheets

(56) References Cited

FOREIGN PATENT DOCUMENTS

| | | | |
|---|---|---|---|
| CN | 103198601 | A | 7/2013 |
| CN | 103218986 | A | 7/2013 |
| CN | 104517576 | A | 4/2015 |
| CN | 105304010 | A | 2/2016 |
| CN | 107564466 | A | 1/2018 |
| CN | 107665677 | A | 2/2018 |
| CN | 107886909 | A | 4/2018 |
| TW | 201740383 | A | 11/2017 |
| WO | 2011125699 | A1 | 10/2011 |

OTHER PUBLICATIONS

Written Opinion of the International Search Authority in corresponding International application No. PCT/CN2018/115211.
First Office Action from China patent office in a counterpart Chinese patent Application 201811273767.6, dated Nov. 20, 2019 (7 pages).

* cited by examiner

DRIVING METHOD FOR DISPLAY PANEL AND DRIVING DEVICE THEREOF

The present application claims priority to Chinese Patent Application No. CN201811273767.6, filed to the Chinese Patent Office on Oct. 30, 2018, and entitled "DRIVING METHOD FOR DISPLAY PANEL AND DRIVING DEVICE THEREOF", which is incorporated herein by reference in its entirety.

TECHNICAL FIELD

The present application relates to the technical field of display, and in particular, to a driving method for a display panel and a driving device thereof.

BACKGROUND

The statements herein merely provide background information related to the present application and do not necessarily constitute the prior art.

With the development and advancement of technology, liquid crystal displays have become mainstream display products due to their thin bodies, power saving and low radiation, etc, and have been widely used. Most of the liquid crystal displays are backlight type liquid crystal displays which each include a liquid crystal panel and a backlight module. The working principle of the liquid crystal panel is that liquid crystal molecules are placed between two parallel glass substrates and a driving voltage is applied on the two glass substrates to control the rotating direction of the liquid crystal molecules, so as to refract light of the backlight module to generate a picture.

A thin film transistor-liquid crystal display (TFT-LCD) has gradually occupied a dominant position in the display field due to its low power consumption, excellent picture quality and high production yield and the like. Similarly, the thin film transistor-liquid crystal display includes a liquid crystal panel and a backlight module, where the liquid crystal panel includes a color filter (CF) substrate, a thin film transistor (TFT) substrate, and a photomask. Transparent electrodes are present on the opposite inner sides of the aforementioned substrates. A layer of liquid crystal (LC) molecules is sandwiched between the two substrates.

There are various types of displays. Some displays including a vertical alignment liquid crystal displays (VA-LCD) have a problem that a side view effect is not good.

SUMMARY

An objective of the present application is to provide a driving method for a display panel and a driving device thereof to solve the problem that a side view effect of the display panel is not good.

To achieve the above objective, the present application provides a driving method for a display panel, which includes steps of:

dividing all pixels each including a red sub-pixel, a green sub-pixel, a blue sub-pixel, and a white sub-pixel into bright pixels and dark pixels, the bright pixels and the dark pixels being in a cross arrangement;

receiving three primary color signals including an R signal, a G signal, and a B signal, and converting the three primary color signals into four primary color signals including a W signal, an R' signal, a G' signal, and a B' signal: where the W signal being equal to a minimum value among the R signal, the G signal, and the B signal: the R' signal being the R signal minus the W signal; the G' signal being the G signal minus the W signal; the B' signal being the B signal minus the W signal; converting the W signal, the R' signal, the G' signal, and the B' signal to bright region driving signals including a W1 signal, an R1 signal, a G1 signal, and a B1 signal, and dark region driving signals including a W2 signal, an R2 signal, a G2 signal, and a B2 signal based on a display lookup table;

driving the bright pixels and the dark pixels respectively by using the bright region driving signals including the W1 signal, the R1 signal, the G1 signal, and the B1 signal, and the dark region driving signals including the W2 signal, the R2 signal, the G2 signal, and the B2 signal;

where the display lookup table is generated based on four primary color signals, a bright region gamma curve, and a dark region gamma curve; an average value of the generated bright region driving signals and the generated dark region driving signals is consistent with a front view angle gamma curve target value and a side view angle gamma curve target value: the front view angle gamma curve target value is 2.2, and the side view angle gamma curve target value is at least 1.2 and no more than 2.2.

The present application provides another driving method for a display panel, which includes steps of:

dividing all pixels into bright pixels and dark pixels, the bright pixels and the dark pixels being in a cross arrangement;

converting driving signals into bright region driving signals obtained based on a bright region gamma curve and dark region driving signals obtained based on a dark region gamma curve; and driving the bright pixels and the dark pixels respectively by using the bright region driving signals and the dark region driving signals.

Optionally, the bright pixels and the dark pixels each include a red sub-pixel, a green sub-pixel, a blue sub-pixel, and a white sub-pixel.

Optionally, the step of converting driving signals into bright region driving signals obtained based on a bright region gamma curve and dark region driving signals obtained based on a dark region gamma curve includes: receiving three primary color signals and converting the three primary color signals into four primary color signals:

converting the four primary color signals into bright region four primary color signals based on the bright region gamma curve; and meanwhile, converting the four primary color signals into dark region four primary color signals based on the dark region gamma curve.

Optionally, the step of converting driving signals into bright region driving signals obtained based on a bright region gamma curve and dark region driving signals obtained based on a dark region gamma curve includes: converting the driving signals into bright region driving signals and dark region driving signals by using a display lookup table.

Optionally, the display lookup table is generated based on four primary color signals, a bright region gamma curve, and a dark region gamma curve; and an average value of the generated bright region driving signals and the generated dark region driving signals is consistent with a front view angle gamma curve target value and a side view angle gamma curve target value.

Optionally, the step of converting the three primary color signals into four primary color signals, and then converting the four primary color signals into two sets of signals includes: the three primary color signals including an R signal, a G signal, and a B signal; the four primary color signals including a W signal, an R' signal, a G' signal, and a B' signal: where the W signal being equal to a minimum value among the R signal, the G signal, and the B signal; the R' signal being the R signal minus the W signal; the G' signal being the G signal minus the W signal; the B' signal being the B signal minus the W signal; the W signal, the R' signal, the G signal, and the B' signal being four primary color signals obtained by converting the three primary color signals; and converting, based on a display lookup table, the W signal, the R' signal, the G' signal, and the B' signal into bright region driving signals including a W1 signal, an R1 signal, a G1 signal, and a B1 signal, and dark region driving signals including a W2 signal, an R2 signal, a G2 signal, and a B2 signal.

Optionally, the front view angle gamma curve target value is 2.2, and the side view angle gamma curve target value is at least 1.2 and no more than 2.2; and an average value of the bright region driving signals including the W1 signal, the R1 signal, the G1 signal, and the B1 signal, and the dark region driving signals including the W2 signal, the R2 signal, the G2 signal, and the B2 signal is consistent with a front view angle gamma curve target value and a side view angle gamma curve target value.

The present application also provides a driving device for a display panel, which drives the display panel by using the above driving method for a display panel, the driving device including: a driver; the driver includes: a dividing circuit that divides all pixels into bright pixels and dark pixels, where the bright pixels and the dark pixels are in a cross arrangement; a conversion circuit that converts driving signals into bright region driving signals obtained based on a bright region gamma curve and dark region driving signals obtained based on a dark region gamma curve; and a driving circuit that drives the bright pixels and the dark pixels respectively by using the bright region driving signals and the dark region driving signals.

Optionally, the bright pixels and the dark pixels each include a red sub-pixel, a green sub-pixel, a blue sub-pixel, and a white sub-pixel.

The conversion circuit receives three primary color signals including an R signal, a G signal, and a B signal, converts the three primary color signals into four primary color signals including a W signal, an R' signal, a G' signal, and a B' signal, and converts the four primary color signals into bright region driving signals including a W1 signal, an R1 signal, a G1 signal, and a B1 signal, and dark region driving signals including a W2 signal, an R2 signal, a G2 signal, and a B2 signal; where the W signal is equal to a minimum value among the R signal, the G signal, and the B signal; the R' signal is the R signal minus the W signal: the G' signal is the G signal minus the W signal; the B' signal is the B signal minus the W signal; the W signal, the R' signal, the G' signal, and the B' signal are the four primary color signals obtained by converting the three primary color signals;

the display lookup table is generated based on four primary color signals, a bright region gamma curve, and a dark region gamma curve; an average value of the generated bright region driving signals and the generated dark region driving signals is consistent with a front view angle gamma curve target value and a side view angle gamma curve target value; the front view angle gamma curve target value is 2.2, and the side view angle gamma curve target value is at least 1.2 and no more than 2.2.

Because of the birefringence of liquid crystal, a vertical alignment type liquid crystal display (VA-LCD) has different image quality at a side view angle; in this solution, the pixels of the display panel are divided into the bright pixels and the dark pixels, and the bright pixels and the dark pixels are in a cross arrangement. Therefore, the bright pixels and the dark pixels can compensate for each other to reduce color shift; the driving signals are converted into the bright region driving signals based on the bright region gamma curve and the dark region driving signals obtained based on the dark region gamma curve, so that the signals correspond to the pixels, and the bright pixels and the dark pixels are driven respectively by using the bright region driving signals and the dark bright region driving signals, to obtain the bright pixels and the dark pixels that meet the design requirements.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts.

In the accompanying drawings.

DETAILED DESCRIPTION

Figure 1:
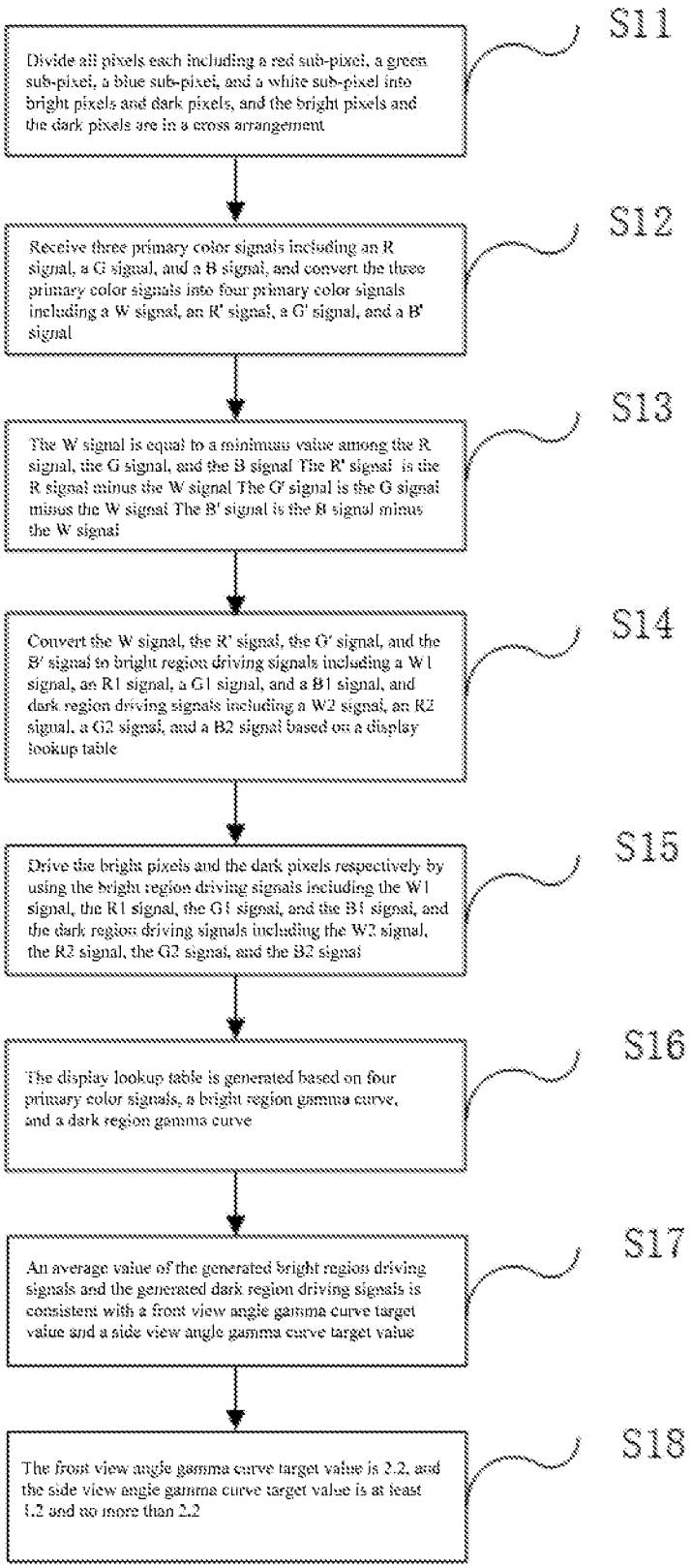
FIG. 1 is an application flow chart of a driving method for a display panel according to an embodiment of the present application.
Figure 2:
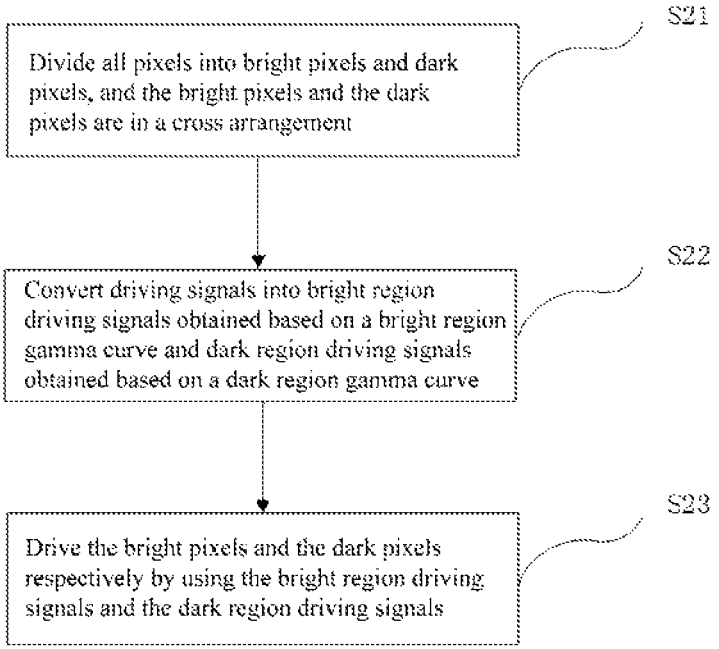
FIG. 2 is an application flow chart of a driving method for a display panel according to an embodiment of the present application.

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms such as "first" and "second" are merely for a descriptive purpose, and cannot be understood as indicating or implying a relative importance, or implicitly indicating the number of the indicated technical features. Hence, the features defined by "first" and "second" can explicitly or implicitly include one or more features. In the description of the present application. "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood by those skilled in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

An exemplary pixel design method, namely adding a white pixel, can effectively improve the transmittance characteristics of a panel, so that the arrangement of pixels is changed from red green blue (RGB) three primary color pixels to white red green blue (WRGB) four primary color pixel.

Therefore, in the case where total sub-pixels are the same, a gain contribution of panel brightness is: resolution *[(WR)+(WG)+(WB)]/4 brightness gain; however, in a vertical alignment liquid crystal display panel, since the side view angle gamma curve shift is severe, the WRGB side view performance is also poor, so a low color shift technology that can be applied to WRGB displays is quite important.

The present application will be further described below with reference to the accompanying drawings and optional embodiments.

Figure 5:
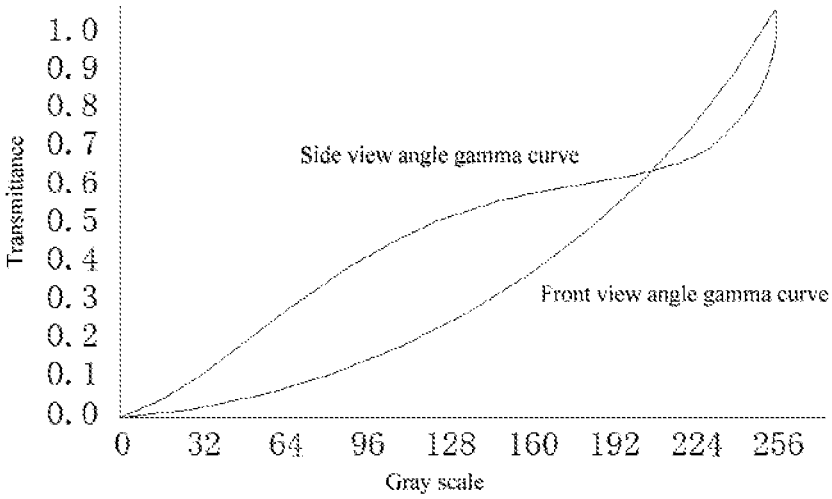
FIG. 5 is a schematic view of a gamma curve of a display panel before the implementation of an embodiment of the present application.
Figure 6:
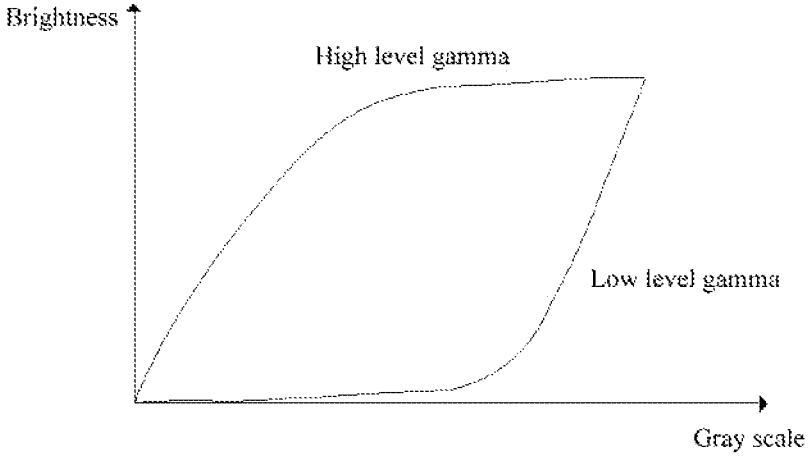
FIG. 6 is a schematic view of a gamma curve of a display panel after the implementation of an embodiment of the present application.
Figure 7:
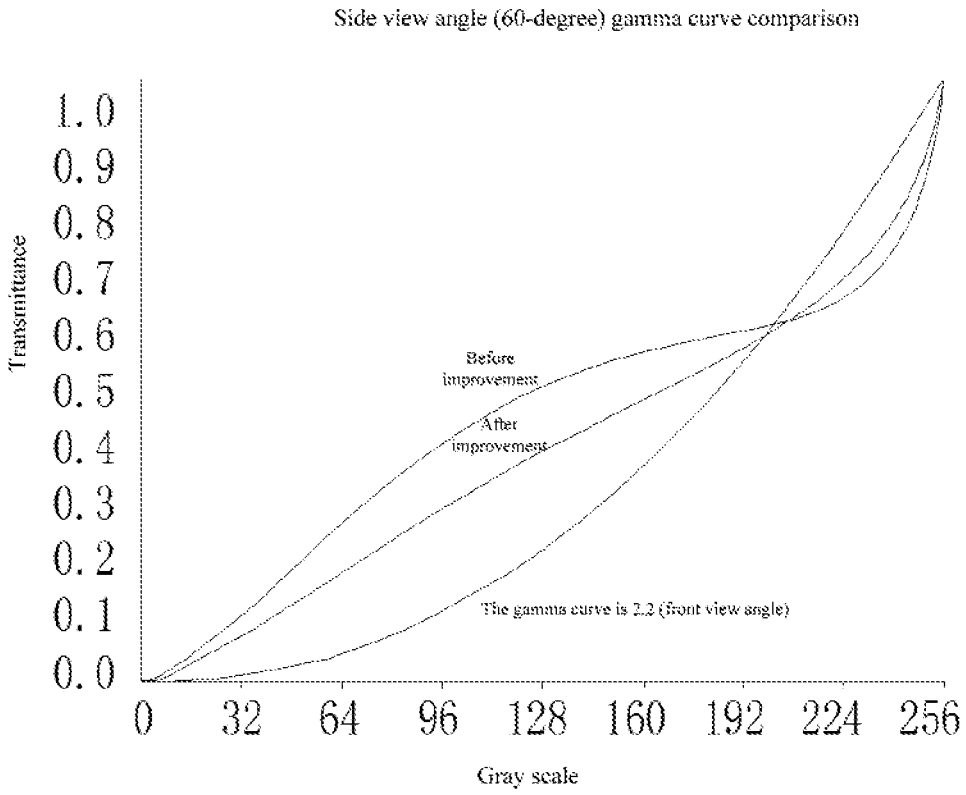
FIG. 7 is a schematic view of a gamma curve of a display panel after the implementation of an embodiment of the present application.
Figure 8:
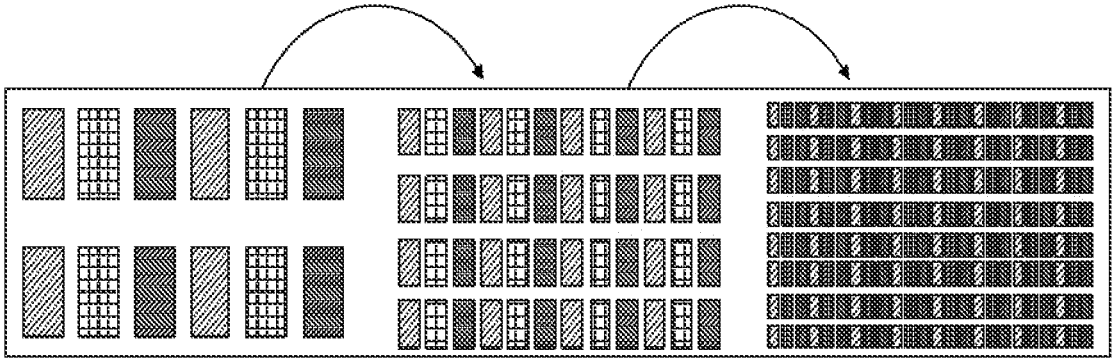
FIG. 8 is a schematic view of resolution changes of a display panel before the implementation of an embodiment of the present application.

Referring to FIG. 5 and FIG. 8, as the resolution of a display becomes higher and higher, the transmittance characteristic of the display is an important indicator of the competitiveness of the liquid crystal display (LCD), and especially the resolution of the LCD has rapidly evolved from full high definition (FHD) to ultra-low dispersion (UD) resolution. In the next few years, even 8K resolution will also be gradually applied, but in the displays with the same size, the higher the resolution, the more traces of TFT components and related signals in a unit area. These TFT components and signal traces are usually made of opaque metal materials. The more the opaque materials per unit area, the lower the light transmittance per unit area. As a result, the light conversion efficiency of the display is low, resulting in higher and higher display costs. Therefore, a high-transparency thin film transistor-liquid crystal display (TFT-LCD) pixel design is quite important.

As shown in FIG. 1, an embodiment of the present application discloses a driving method for a display panel, including steps:

S11: Divide all pixels each including a red sub-pixel 3, a green sub-pixel 4, a blue sub-pixel 5, and a white sub-pixel 6 into bright pixels 1 and dark pixels 2, and the bright pixels 1 and the dark pixels 2 is in a cross arrangement.

S12: Receive three primary color signals including an R signal, a G signal, and a B signal, and convert the three primary color signals into four primary color signals including a W signal, an R' signal, a G' signal, and a B' signal.

S13: The W signal is equal to a minimum value among the R signal, the G signal, and the B signal; the R' signal is the R signal minus the W signal; the G' signal is the G signal minus the W signal; and the B' signal is the B signal minus the W signal.

S14: Convert the W signal, the R' signal, the G' signal, and the B' signal to bright region driving signals including a W1 signal, an R1 signal, a G1 signal, and a B1 signal, and dark region driving signals including a W2 signal, an R2 signal, a G2 signal, and a B2 signal based on a display lookup table.

S15: Drive the bright pixels 1 and the dark pixels 2 respectively by using the bright region driving signals including the W1 signal, the R1 signal, the G1 signal, and the B1 signal, and the dark region driving signals including the W2 signal, the R2 signal, the G2 signal, and the B2 signal.

S16: The display lookup table is generated based on four primary color signals, a bright region gamma curve, and a dark region gamma curve.

S17: An average value of the generated bright region driving signals and the generated dark region driving signals is consistent with a front view angle gamma curve target value and a side view angle gamma curve target value.

S18: The front view angle gamma curve target value is 2.2, and the side view angle gamma curve target value is at least 1.2 and no more than 2.2.

In this solution, the more the opaque materials per unit area in the display panel, the lower the light transmittance per unit area, thereby reducing the light conversion efficiency of the display panel and increasing the cost of the display panel; in this solution, the pixels of the display panel are divided into bright pixels 1 and dark pixels 2, and the bright pixels 1 and the dark pixels 2 are in a cross arrangement. Therefore, the bright pixels 1 and the dark pixels 2 can compensate for each other to reduce the color shift; and the bright pixels 1 and the dark pixels 2 each include RGBW sub-pixels. Since a W pixel has no color filter, the transmittance is high, and the effect of the brightness is improved, and W allows the light of a light source to be completely transmitted. This solution adopts the RGBW solution to effectively improve the light transmission characteristics of the display panel, and improve the light transmittance per unit area. First, the three primary color signals are converted into the four primary color signals, where the W signal is equal to the minimum value among the R signal, the G signal, and the B signal, so that the influence of the W pixel on an overall display effect can be controlled under the conditions that the light transmittance is improved and the backlight power consumption is reduced, and the problem that the display effect is too white is solved; on this basis, by the use of the display lookup table obtained by debugging the bright region gamma curve and the dark region gamma curve according to the present application, the two sets of driving signals corresponding to the bright pixels 1 and the dark pixel 2 respectively are obtained by conversion; thus, by using the two sets of driving signals obtained by the conversion to drive the panel, the problem of color shift is better solved, and in particular, the problem that the display effect of the display panel is not good under the side view angle is solved. An average value of the two sets of signals conforms to the front view angle gamma curve target value and the side view angle gamma curve target value, so that an average value of the formed gamma curves of the bright pixels 1 and the dark pixels 2 driven by the two sets of signals is the front view angle gamma curve target value and the side view angle gamma curve target value, and an optimal solution that conforms to the target curves can be obtained by adjusting the bright region gamma curve and the dark region gamma curve. The quality of the gamma curve optimization directly determines whether the display screen will be subjected to whitening, lack of sharpness and insufficient detail. A brightness coefficient curve of the display panel is close to a standard curve (under luminosity of 2.2), indicating that this display panel can correctly reset the screen brightness and contrast; and if the deviation is larger, it means that the display is less capable of resetting brightness and contrast. In this solution, the front view angle gamma curve target value is 2.2, and the side view angle gamma curve target value is at least 1.2 and no more than 2.2, which is consistent with the correction of the visual sensitivity of each gray scale to the human eye brightness, optimizes the front view angle gamma and the side view angle gamma, optimizes brightness and contrast, and reduces color shift of the display panel.

As another embodiment of the present application, referring to FIG. 2, FIG. 4, FIG. 6, and FIG. 7, a driving method for a display panel is disclosed, including steps:

S21: Divide all pixels into bright pixels 1 and dark pixels 2, and the bright pixels 1 and the dark pixels 2 are in a cross arrangement.

S22: Convert driving signals into bright region driving signals obtained based on a bright region gamma curve and dark region driving signals obtained based on a dark region gamma curve.

S23: Drive the bright pixels 1 and the dark pixels 2 respectively by using the bright region driving signals and the dark region driving signals.

Because of the birefringence of liquid crystal, a vertical alignment type liquid crystal display (VA-LCD) has different image quality at a side view angle; in this solution, the pixels of the display panel are divided into the bright pixels 1 and the dark pixels 2, and the bright pixels 1 and the dark pixels 2 are in a cross arrangement. Therefore, the bright pixels 1 and the dark pixels 2 can compensate for each other to reduce color shift; the driving signals are converted into the bright region driving signals based on the bright region gamma curve and the dark region driving signals obtained based on the dark region gamma curve, so that the signals correspond to the pixels, and the bright pixels 1 and the dark pixels 2 are driven respectively by using the bright region driving signals and the dark bright region driving signals, to obtain the bright pixels 1 and the dark pixels 2 that meet the design requirements.

In an embodiment, the bright pixels 1 and the dark pixels 2 each include a red sub-pixel 3, a green sub-pixel 4, a blue sub-pixel 5, and a white sub-pixel 6.

In this solution, the more opaque materials per unit area in the display panel, the lower the light transmittance per unit area, thereby reducing the light conversion efficiency of the display panel and increasing the cost of the display panel; in this solution, on the basis of dividing the pixels into the bright pixels 1 and the dark pixels 2, the bright pixels 1 and the dark pixels 2 each include RGBW sub-pixels. Since a W pixel has no color filter, the transmittance is high, and the effect of the brightness is improved, and W allows the light of a light source to be completely transmitted. This solution adopts the RGBW solution to effectively improve the light transmission characteristics of the display panel, and improve the light transmittance per unit area.

In an embodiment, the step of converting driving signals into bright region driving signals obtained based on a bright region gamma curve and dark region driving signals obtained based on a dark region gamma curve includes: receiving three primary color signals and converting the three primary color signals into four primary color signals; converting the four primary color signals into bright region four primary color signals based on the bright region gamma curve; and meanwhile, converting the four primary color signals into dark region four primary color signals based on the dark region gamma curve.

In this solution, an RGBW pixel setting solution is adopted. However, although the W pixel brings high light transmittance, because of the setting solution thereof, in the display, especially in the VA type display, the side-view picture quality will be different due to the birefringence effect of the liquid crystal, i.e., the side view gamma angle curve shift is severe, which is reflected in that the side view performance effect is not good; in this solution, based on the RGBW solution, the panel is divided into dark pixels 2 and the bright pixels 1, and the dark pixels and the bright pixels are in a cross arrangement, so that the two regions of the bright pixel 1 and the dark pixel 2 compensate for each other, and the side view angle characteristics of the panel are improved. Besides, on this basis, we also adjust the gamma curve correspondingly, i.e., the bright pixel 1 and the dark pixel 2 are driven respectively by the bright region driving signals obtained based on the bright region gamma curve and the dark region driving signals based on the dark region gamma curve, so that after we can adjust the bright region gamma curve and the dark region gamma curve and make the curves cooperate, the obtained front view angle gamma curve and side view angle gamma curve can be closer to a front view angle gamma target value and a side view angle gamma target value by adjusting the bright region gamma curve and the dark region gamma curve. Therefore, the present application does not need to sacrifice a pixel aperture ratio for designing a pixel domain, and can optimize the view-angle picture quality of the display panel while effectively increasing the pixel aperture ratio, thereby improving a situation with a poor side view angle the side of the display panel. In addition, the bright pixels 1 and the dark pixels 2 each include RGBW sub-pixels, and the bright pixels 1 and the dark pixel 2 are driven respectively by using the bright region driving signals and the dark region driving signals. In order that the bright region driving signals and the dark region driving signals can drive the RGBW sub-pixels in the bright pixels 1 and the dark pixels 2, the three primary color signals are converted into four primary color signals: the four primary color signals obtained by conversion are converted into two sets of signals, and the two sets of signals drive the RGBW sub-pixels in the bright pixels 1 and the RGBW sub-pixels in the dark pixels 2 respectively, to achieve the purpose of driving of the signals corresponding to the pixels, thereby ensuring further implementation of the solution.

In an embodiment, the step S22 of converting driving signals into bright region driving signals obtained based on a bright region gamma curve and dark region driving signals obtained based on a dark region gamma curve includes:

converting the driving signals into bright region driving signals and dark region driving signals by using a display lookup table.

In this solution, in order to improve the display effect by making the bright pixels 1 and the dark pixels 2 better compensate for each other, a display lookup table is adopted, and the driving signals are converted into the bright region driving signals and the dark region driving signals by using the display lookup table (LUT) according to the difference between driving targets of the bright pixels 1 and the dark pixels 2; through the conversion of the display LUT, the optimal driving signals that conform to the bright pixels 1 and the dark pixels 2 can be found to achieve better driving effect, and the purpose of reducing the color shift of the display panel is achieved, thereby achieving better side view characteristics.

In an embodiment, the display lookup table is generated based on four primary color signals, a bright region gamma curve, and a dark region gamma curve; and an average value of the generated bright region driving signals and the generated dark region driving signals is consistent with a front view angle gamma curve target value and a side view angle gamma curve target value.

In this solution, since the display lookup table (LUT) fully takes into account information such as bright pixels 1, dark pixels 2, four primary color signals, a bright region gamma curve, and a dark region gamma curve, an average value of the bright region driving signals and the dark region driving signals that are generated by using the display lookup table is formed according to the requirements of a front view angle gamma curve target value and a side view angle gamma curve target value: it is ensured that the conversion of the driving signals into the bright region driving signals and the dark region driving signals by using the display LUT conforms to the overall conception of the present application, and an optimal solution conforming to target gamma curve is obtained by conversion, thereby improving the view angle characteristics of the VA-LCD, and particularly solving the problem of a poor side view angle display effect.

In an embodiment, the step of converting the three primary color signals into four primary color signals, and then converting the four primary color signals into two sets of signals includes: the three primary color signals including an R signal, a G signal, and a B signal; the four primary color signals including a W signal, an R' signal, a G' signal, and a B' signal; where the W signal being equal to a minimum value among the R signal, the G signal, and the B signal; the R' signal being the R signal minus the W signal; the G signal being the G signal minus the W signal: the B' signal being the B signal minus the W signal; the W signal, the R' signal, the G' signal, and the B' signal being four primary color signals obtained by converting the three primary color signals; and converting, based on a display lookup table, the W signal, the R' signal, the G' signal, and the B' signal into bright region driving signals including a W1 signal, an R1 signal, a G1 signal, and a B1 signal, and dark region driving signals including a W2 signal, an R2 signal, a G2 signal, and a B2 signal.

In this solution, first, the three primary color signals are converted into the four primary color signals, where the W signal is equal to the minimum value among the R signal, the G signal, and the B signal, so that the influence of the W pixel on an overall display effect can be controlled under the conditions that the light transmittance is improved and the backlight power consumption is reduced, and the problem that the display effect is too white is solved; on this basis, by the use of the display lookup table obtained by debugging the bright region gamma curve and the dark region gamma curve according to the present application, the two sets of driving signals corresponding to the bright pixels 1 and the dark pixel 2 respectively are obtained by conversion; thus, by using the two sets of driving signals obtained by the conversion to drive the panel, the problem of color shift is better solved, and in particular, the problem that the display effect of the display panel is not good under the side view angle is solved.

In an embodiment, a front view angle gamma curve target value is 2.2, and a side view angle gamma curve target value is at least 1.2 and no more than 2.2; and an average value of bright region driving signals including a W1 signal, an R1 signal, a G1 signal, and a B1 signal, and dark region driving signals including a W2 signal, an R2 signal, a G2 signal, and a B2 signal is consistent with a front view angle gamma curve target value and a side view angle gamma curve target value.

In this solution, an average value of bright region driving signals including a W1 signal, an R1 signal, a G1 signal, and a B1 signal, and dark region driving signals including a W2 signal, an R2 signal, a G2 signal, and a B2 signal conforms to a front view angle gamma curve target value and a side view angle gamma curve target value, so that an average value of the formed gamma curves of the bright pixels 1 and the dark pixels 2 driven by the bright region driving signals including the W1 signal, the R1 signal, the G1 signal, and the B1 signal, and the dark region driving signals including the W2 signal, the R2 signal, the G2 signal, and the B2 signal is the gamma curve of the front view angle gamma curve target value and the side view angle gamma curve target value, and an optimal solution that conforms to the target curves can be obtained by adjusting the bright region gamma curve and the dark region gamma curve. The quality of the gamma curve optimization directly determines whether the display screen will be subjected to whitening, lack of sharpness and insufficient detail. A brightness coefficient curve of the display panel is close to a standard curve (under luminosity of 2.2), indicating that this display panel can correctly reset the screen brightness and contrast; and if the deviation is larger, it means that the display is less capable of resetting brightness and contrast. In this solution, the front view angle gamma curve target value is 2.2, and the side view angle gamma curve target value is at least 1.2 and no more than 2.2, which is consistent with the correction of the visual sensitivity of each gray scale to the human eye brightness, optimizes the front view angle gamma and the side view angle gamma, optimizes brightness and contrast, and reduces color shift of the display panel.

Figure 3:
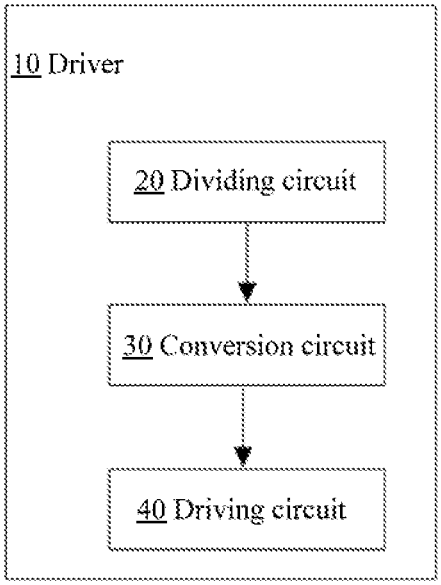
FIG. 3 is a schematic view of a driving device for a display panel according to an embodiment of the present application.
Figure 4:
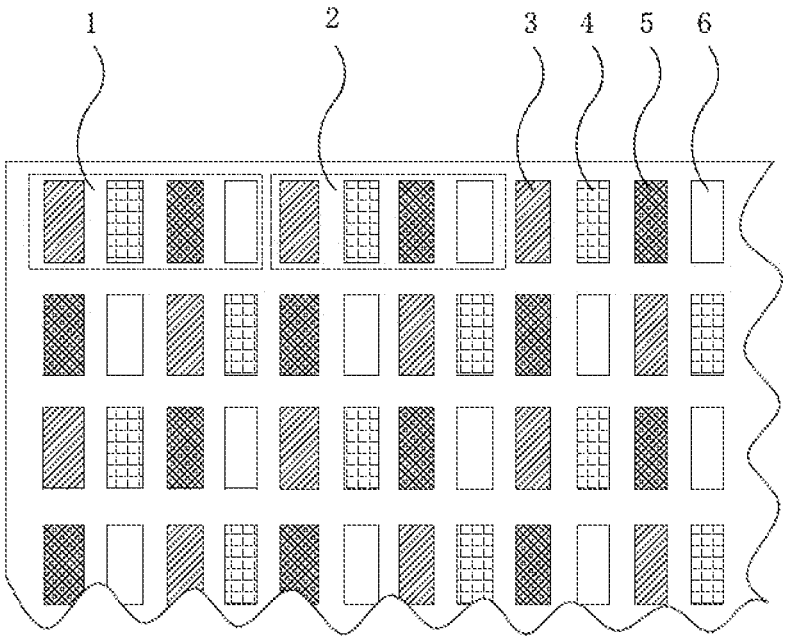
FIG. 4 is a schematic view of pixels for a display panel according to an embodiment of the present application.

As another embodiment of the present application, referring to FIG. 3, a driving device for a display panel is disclosed, including: a driver 10; the driver 10 includes: a dividing circuit 20 that divides all pixels into bright pixels 1 and dark pixels 2, where the bright pixels 1 and the dark pixels 2 are in a cross arrangement; a conversion circuit 30 for converting driving signals into bright region driving signals obtained based on a bright region gamma curve and dark region driving signals obtained based on a dark region gamma curve; and a driving circuit 40 that drives the bright pixels 1 and the dark pixels 2 respectively by using the bright region driving signals and the dark region driving signals.

Because of the birefringence of liquid crystal, a VA-LCD has different image quality at a side view angle; in this solution, the dividing circuit 20 divides the pixels of the display panel into the bright pixels 1 and the dark pixels 2, and the bright pixels 1 and the dark pixels 2 are in a cross arrangement. Therefore, the bright pixels 1 and the dark pixels 2 can compensate for each other to reduce color shift; the conversion circuit 30 converts the driving signals into the bright region driving signals based on the bright region gamma curve and the dark region driving signals obtained based on the dark region gamma curve, so that the signals correspond to the pixels; the driving circuit 40 drives the bright pixels 1 and the dark pixels 2 respectively by using the bright region driving signals and the dark bright region driving signals, to obtain the bright pixels 1 and the dark pixels 2 that meet the design requirements.

In the present application, the driving device applies the above-mentioned driving method.

In an embodiment, the bright pixels 1 and the dark pixels 2 each include a red sub-pixel 3, a green sub-pixel 4, a blue sub-pixel 5, and a white sub-pixel 6.

The conversion circuit 30 receives three primary color signals including an R signal, a G signal, and a B signal, converts the three primary color signals into four primary color signals including a W signal, an R' signal, a G' signal, and a B' signal, and converts the four primary color signals into bright region driving signals including a W1 signal, an R1 signal, a G1 signal, and a B1 signal, and dark region driving signals including a W2 signal, an R2 signal, a G2 signal, and a B2 signal; where the W signal is equal to a minimum value among the R signal, the G signal, and the B signal; the R' signal is the R signal minus the W signal: the G' signal is the G signal minus the W signal; the B' signal is the B signal minus the W signal; the W signal, the R' signal, the G' signal, and the B' signal are the four primary color signals obtained by converting the three primary color signals;

the display lookup table is generated based on four primary color signals, a bright region gamma curve, and a dark region gamma curve; an average value of the generated bright region driving signals and the generated dark region driving signals is consistent with a front view angle gamma curve target value and a side view angle gamma curve target value; the front view angle gamma curve target value is 2.2, and the side view angle gamma curve target value is at least 1.2 and no more than 2.2.

What is claimed is:

1. A driving method for a display panel, comprising steps of:

dividing all pixels into bright pixels and dark pixels, the bright pixels and the dark pixels being in a cross arrangement;

converting driving signals into bright region driving signals obtained based on a bright region gamma curve and dark region driving signals obtained based on a dark region gamma curve; and driving the bright pixels and the dark pixels respectively by using the bright region driving signals and the dark region driving signals;

wherein the step of converting driving signals into bright region driving signals obtained based on a bright region gamma curve and dark region driving signals obtained based on a dark region gamma curve comprises:

converting the driving signals into bright region driving signals and dark region driving signals by using a display lookup table;

wherein the display lookup table is generated based on four primary color signals, a bright, a bright region gamma curve, and a dark region gamma curve; and an average value of the generated bright region driving signals and the generated dark region driving signals is consistent with a front view angle gamma curve target value and a side view angle gamma curve target value.

2. The driving method for a display panel according to claim 1, wherein the bright pixels and the dark pixels each comprise a red sub-pixel, a green sub-pixel, a blue sub-pixel, and a white sub-pixel.

3. The driving method for a display panel according to claim 2, wherein the step of converting driving signals into bright region driving signals obtained based on a bright region gamma curve and dark region driving signals obtained based on a dark region gamma curve comprises:

receiving three primary color signals and converting the three primary color signals into four primary color signals.

4. The driving method for a display panel according to claim 3, wherein after the step of receiving three primary color signals and converting the three primary color signals into four primary color signals, the method further includes converting the four primary color signals into bright region four primary color signals based on the bright region gamma curve; and meanwhile, converting the four primary color signals into dark region four primary color signals based on the dark region gamma curve.

5. The driving method for a display panel according to claim 4, wherein the step of receiving three primary color signals and converting the three primary color signals into four primary color signals comprises:

the three primary color signals comprising an R signal, a G signal, and a B signal;

the four primary color signals comprising a W signal, an R' signal, a G' signal, and a B' signal;

wherein the W signal being equal to a minimum value among the R signal, the G signal, and the B signal;

the R' signal being the R signal minus the W signal;

the G' signal being the G signal minus the W signal;

the B' signal being the B signal minus the W signal;

the W signal, the R' signal, the G' signal, and the B' signal are four primary color signals obtained by converting the three primary color signals; and the step of converting the four primary color signals into bright region four primary color signals based on the bright region gamma curve; and meanwhile, converting the four primary color signals into dark region four primary color signals based on the dark region gamma curve comprises:

converting the W signal, the R' signal, the G' signal, and the B' signal to bright region driving signals comprising a W1 signal, an R1 signal, a G1 signal, and a B1 signal, and dark region driving signals comprising a W2 signal, an R2 signal, a G2 signal, and a B2 signal based on a display lookup table.

6. The driving method for a display panel according to claim 5, wherein the front view angle gamma curve target value is 2.2, and the side view angle gamma curve target value is at least 1.2 and no more than 2.2; and an average value of the bright region driving signals comprising the W1 signal, the R1 signal, the G1 signal, and the B1 signal, and the dark region driving signals comprising the W2 signal, the R2 signal, the G2 signal, and the B2 signal is consistent with a front view angle gamma curve target value and a side view angle gamma curve target value.

7. A driving method for a display panel, comprising steps of:

dividing all pixels each comprising a red sub-pixel, a green sub-pixel, a blue sub-pixel, and a white sub-pixel into bright pixels and dark pixels, the bright pixels and the dark pixels being in a cross arrangement;

receiving three primary color signals comprising an R signal, a G signal, and a B signal, and converting the three primary color signals into four primary color signals comprising a W signal, an R' signal, a G' signal, and a B' signal;

wherein the W signal being equal to a minimum value among the R signal, the G signal, and the B signal;

the R' signal being the R signal minus the W signal;

the G' signal being the G signal minus the W signal;

the B' signal being the B signal minus the W signal;

converting the W signal, the R' signal, the G' signal, and the B' signal to bright region driving signals comprising a W1 signal, an R1 signal, a G1 signal, and a B1 signal, and dark region driving signals comprising a W2 signal, an R2 signal, a G2 signal, and a B2 signal based on a display lookup table;

driving the bright pixels and the dark pixels respectively by using the bright region driving signals comprising the W1 signal, the R1 signal, the G1 signal, and the B1 signal, and the dark region driving signals comprising the W2 signal, the R2 signal, the G2 signal, and the B2 signal;

wherein the display lookup table is generated based on four primary color signals, a bright region gamma curve, and a dark region gamma curve; an average value of the generated bright region driving signals and the generated dark region driving signals is consistent with a front view angle gamma curve target value and a side view angle gamma curve target value; the front view angle gamma curve target value is 2.2, and the side view angle gamma curve target value is at least 1.2 and no more than 2.2.

8. A driving device for a display panel, comprising: a driver; the driver comprises:

a dividing circuit that divides all pixels into bright pixels and dark pixels, the bright pixels and the dark pixels being in a cross arrangement;

a conversion circuit that converts driving signals into bright region driving signals obtained based on a bright region gamma curve and dark region driving signals obtained based on a dark region gamma curve; and a driving circuit that drives the bright pixels and the dark pixels respectively by using the bright region driving signals and the dark region driving signals;

wherein the conversion circuit comprises a display lookup table that converts the driving signals into bright region driving signals and dark region driving signals;

wherein the display lookup table is generated based on four primary color signals, a bright region gamma curve, and a dark region gamma curve; and an average value of the bright region driving signals and the dark region driving signals is consistent with a front view angle gamma curve target value and a side view angle gamma curve target value.

9. The driving device for a display panel according to claim 8, wherein the bright pixels and the dark pixels each comprise a red sub-pixel, a green sub-pixel, a blue sub-pixel, and a white sub-pixel.

10. The driving device for a display panel according to claim 9, wherein the conversion circuit receives three primary color signals and converts the received three primary color signals into four primary color signals.

11. The driving device for a display panel according to claim 10, wherein the conversion circuit converts four primary color signals into bright region four primary color signals based on the bright region gamma curve, and meanwhile converts the four primary color signals into dark region four primary color signals based on the dark region gamma curve.

12. The driving device for a display panel according to claim 11, wherein the three primary color signals comprise an R signal, a G signal, and a B signal;

the four primary color signals comprise a W signal, an R' signal, a G' signal, and a B' signal;

wherein the W signal is equal to a minimum value among the R signal, the G signal, and the B signal;

the R' signal is the R signal minus the W signal;

the G' signal is the G signal minus the W signal;

the B' signal is the B signal minus the W signal;

the W signal, the R' signal, the G' signal, and the B' signal are four primary color signals obtained by converting the three primary color signals; and the W signal, the R' signal, the G' signal, and the B' signal are converted into bright region driving signals comprising a W1 signal, an R1 signal, a G1 signal, and a B1 signal, and dark region driving signals comprising a W2 signal, an R2 signal, a G2 signal, and a B2 signal based on a display lookup table.

13. The driving device for a display panel according to claim 12, wherein the front view angle gamma curve target value is 2.2, and the side view angle gamma curve target value is at least 1.2 and no more than 2.2; and an average value of the bright region driving signals comprising the W1 signal, the R1 signal, the G1 signal, and the B1 signal, and the dark region driving signals comprising the W2 signal, the R2 signal, the G2 signal, and the B2 signal is consistent with a front view angle gamma curve target value and a side view angle gamma curve target value.

* * * * *